United States Patent [19]

Tagawa et al.

[11] Patent Number: 4,651,050

[45] Date of Patent: Mar. 17, 1987

[54] CATHODE RAY TUBE

[75] Inventors: Susumu Tagawa; Shoji Araki; Shinichi Numata, all of Kanagawa, Japan

[73] Assignee: Sony Corporation, Tokyo, Japan

[21] Appl. No.: 701,019

[22] Filed: Feb. 12, 1985

[30] Foreign Application Priority Data

Feb. 16, 1984 [JP] Japan ..... 59-27941

[51] Int. Cl.[4] ..... H01J 29/56; H01J 29/62; H01J 31/26

[52] U.S. Cl. ..... 313/390; 313/432; 313/439; 313/450; 313/460

[58] Field of Search ..... 313/383, 390, 450, 458, 313/460, 432, 439, 434

[56] References Cited

U.S. PATENT DOCUMENTS 3,731,136 5/1973 Roussin ..... 313/434 X
3,890,529 6/1975 Hutter et al. ..... 313/460
3,922,580 11/1975 Hutter ..... 313/432 X

FOREIGN PATENT DOCUMENTS 54-121662 9/1979 Japan ..... 313/439

*Primary Examiner*—David K. Moore
*Assistant Examiner*—K. Wieder
*Attorney, Agent, or Firm*—Hill, Van Santen, Steadman & Simpson

[57] ABSTRACT

A cathode ray tube comprises an envelope, an electron beam source positioned at one end of the envelope, a target positioned at another end of the envelope, and an electrostatic lens means positioned between the electron beam source and the target. The lens means has a first cylindrical electrode and a second cylindrical electrode positioned along the electron beam path to focus the electron beam. The second cylindrical electrode is divided into four patterned electrodes, and each of the deflection electrodes has a lead which is formed across the first cylindrical electrode but is isolated therefrom. The portion of the leads is positioned to cause a predeflection to the electron beam.

6 Claims, 14 Drawing Figures

| $S/S_0$ | 0 | 0.15 | 0.20 | 0.28 | 0.45 | 0.58 |
|---|---|---|---|---|---|---|
| $\vec{E}'/\vec{E}$ | – | 0.2 | 0.28 | 0.4 | 0.6 | 0.8 |
| $V_{P-P}$ (V) | 119.7 | 117.8 | 117.2 | 116.6 | 115.1 | 113.8 |
| $E'_{G3}$ (V) | +500 | +588 | +625 | +694 | +909 | +1190 |
| State of coma | | | | | | |
| Coma aberration (μm) | 6 | 4.2 | 3.5 | 3 | 2 | 1 |

| $S/S_0$ | 0.58 |
|---|---|
| $\vec{E}'/\vec{E}$ | 0.8 |
| $V_{P-P}$ (V) | 113.8 |
| $E'_{G3}$ (V) | +1190 |
| State of coma | |
| Coma aberration (μm) | 1 |

CATHODE RAY TUBE

BACKGROUND OF THE INVENTION

1. Field of the Invention

The present invention relates to cathode ray tubes, and more particularly to a cathode ray tube in which coma aberration is reduced.

2. Description of the Prior Art

The applicant of the present invention has previously proposed a cathode ray tube as shown in FIG. 1 (Japanese Pat. Appln. No. 156167/83).

In FIG. 1, reference numeral 1 designates a glass bulb, numeral 2 a face plate, numeral 3 a target surface (photoelectric conversion surface), numeral 4 indium for cold sealing, numeral 5 a metal ring, and numeral 6 a signal taking metal electrode which passes through the face plate 2 and contacts with the target surface 3. A mesh electrode $G_6$ is mounted on a mesh holder 7. The electrode $G_6$ is connected to the metal ring 5 through the mesh holder 7 and the indium 4. Prescribed voltage, for example, +1200 V is applied to the mesh electrode $G_6$ through the metal ring 5.

Further in FIG. 1, symbols K, $G_1$ and $G_2$ designate a cathode to constitute an electron gun, a first grid electrode and a second grid electrode, respectively. Numeral 8 designates a bead glass to fix these electrodes. Symbol LA designates a beam limitting aperture.

Symbols $G_3$, $G_4$ and $G_5$ designate third, fourth and fifth grid electrodes, respectively. These electrodes $G_3$–$G_5$ are made in process that metal such as chromium or aluminium is evaporated or plated on inner surface of the glass bulb 1 and then prescribed patterns are formed by cutting using a laser, photoetching or the like. These electrodes $G_3$, $G_4$ and $G_5$ constitute the focusing electrode system, and the electrode $G_4$ serves also for deflection.

A ceramic ring 11 with a conductive part 10 formed on its surface is sealed with frit 9 at an end of the glass bulb 1 and the electrode $G_5$ is connected to the conductive part 10. The conductive part 10 is formed by sintering silver paste, for example. Prescribed voltage, for example, +500 V is applied to the electrode $G_5$ through the ceramic ring 11.

The electrode $G_3$ and $G_4$ are formed as clearly seen in a development of FIG. 2. To simplify the drawing, a part which is not coated with metal is shown by black line in FIG. 2. That is, the electrode $G_4$ is made so-called arrow pattern where four electrode portions $H_+$, $H_-$, $V_+$ and $V_-$, each insulated and zigzaged, arranged alternately. In this case, each electrode portion is formed to extend in angular range of 270°, for example. Leads (12 $H_+$), (12 $H_-$), (12 $V_+$) and (12 $V_-$) from the electrode portions $H_+$, $H_-$, $V_+$ and $V_-$ are formed on the inner surface of the glass bulb 1 simultaneously to the formation of the electrodes $G_3 \sim G_5$ in similar manner. The leads (12 $H_+$)~(12 $V_-$) are isolated from and formed across the electrode $G_3$ and in parallel to the envelope axis. Wide contact parts CT are formed at top end portions of the leads ($_{12}$ $H_+$)~(12 $V_-$). In this case, each of the leads (12 $H_+$)~(12 $V_-$) is made sufficiently narrow not to disturb the electric field within the electrode $G_3$. For example, in an envelope of $\frac{2}{3}$ inches (circumference of the electrode $G_3$=50.3 mm), width of each of the leads (12 $H_+$)~(12 $V_-$) is made 0.6 mm. That is, the sum of each area of the four leads (12 $H_+$)~12($V_-$) is made only 4.8% of the total area of the portion of the electrode $G_3$ which includes the leads (12 $H_+$)~(12 $V_-$) (length d of lead x circumference). In FIG. 2, symbol SL designates a slit which is provided so that the electrode $G_3$ is not heated when the electrodes $G_1$ and $G_2$ are heated by means of induction heating from outside of the envelope. Symbol MA designates a mark for angle in register with the face plate.

In FIG. 1, numeral 13 designates a contactor spring. One end of the contactor spring 13 is connected to a stem pin 14, and the other end thereof is contacted with the contact part CT of the above-mentioned leads (12 $H_+$)~(12 $V_-$). The spring 13 and the stem pin 14 are provided for each of the leads (12 $H_+$)~(12 $V_-$). The electrode portion $H_+$ and $H_-$ to constitute the electrode $G_4$ through the stem pins, the springs and the leads (12 $H_+$), (12 $H_-$) and (12 $V_+$) and (12 $V_-$) are supplied with prescribed voltage, for example, horizontal deflection voltage varying in symmetry with respect to 0 V. Also the electrode portions $V_+$ and $V_-$ are supplied with prescribed voltage, for example, vertical deflection voltage varying in symmetry with respect to 0 V.

In FIG. 1, numeral 15 designates another contactor spring. One end of the contactor spring 15 is connected to a stem pin 16, and the other end thereof is contacted with the above-mentioned electrode $G_3$. Prescribed voltage, for example, +500 V is applied to the electrode $G_3$ through the stem pin 16 and the spring 15.

Referring to FIG. 3, equipotential surface of electrostatic lenses formed by the electrodes $G_3 \sim G_6$ is represented by broken line, and electron beam $B_m$ is focused by such formed electrostatic lenses. The landing error is corrected by the electrostatic lens formed between the electrodes $G_5$ and $G_6$. In FIG. 3, the potential represented by broken line excludes the deflection electric field $\vec{E}$.

Deflection of the electron beam $B_m$ is effected by the deflection electric field $\vec{E}$ according to the electrode $G_4$.

If distance from the beam limitting aperture LA to the target surface 3 (envelope length) is represented by l, length x of the deflection electrode $G_4$ and distance y from the beam restricting aperture LA to the center of the electrode $G_4$ are made with the following values, for example, so as to obtain good aberration characteristics.

$$x = \frac{1}{3} l + \frac{1}{20} l \quad (1)$$

$$y = \frac{1}{2} l - \frac{1}{10} l \quad (2)$$

For example, in an envelope of $\frac{2}{3}$ inches, l=46.6 mm, length of the electrode $G_3$ (from the beam limitting aperture LA to the electrode $G_4$)=9.3 mm, length of the electrode $G_4$=17.1 mm, length of the electrode $G_5$=18.2 mm, distance from the electrode $G_5$ to the target=2 mm.

If the beam shape on the target surface 3 is observed in the image pickup tube shown in FIG. 1, a teardrop shape is seen as shown in FIG. 4A and in FIG. 4B where a circular shape is seen at the center but the current density distribution is deviated at the deflection to the right or to the left. In other words, so-called coma aberration is significantly produced in the image pickup tube shown in FIG. 1. If the coma aberration is significantly produced, the modulation degree is lowered at the right side of the frame and the uniform resolution is not obtained and the visual sense is insured. In addition, the amount of the coma aberration is represented by the distance between the original center 0 of the beam and the real position 0' of maximum density.

SUMMARY OF THE INVENTION

In view of such disadvantages in the prior art, an object of the invention is to provide a cathode ray tube wherein the coma aberration is reduced.

In order to attain the above object, for example, leads from four electrode portions of a deflection electrode of arrow pattern are widened and used also as pre-deflection electrodes for deflecting the electron beam preliminarily so as to reduce the coma aberration.

DESCRIPTION OF THE PREFERRED EMBODIMENTS

An embodiment of the invention will now be described referring to the accompanying drawings.

Figure 1:
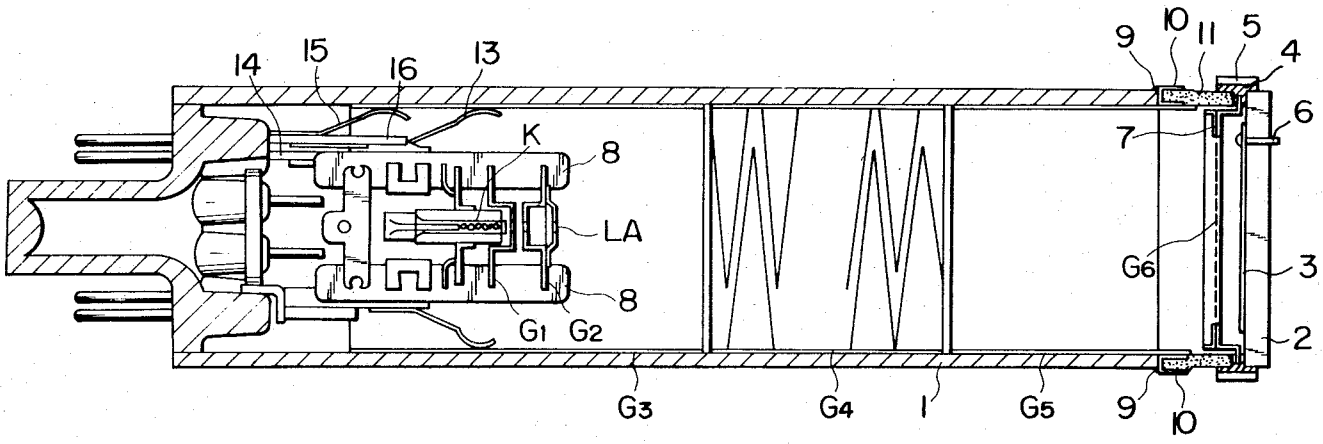
FIG. 1 PRIOR ART
FIG. 1 is a sectional view of an example of an image pickup tube in the prior art.
Figure 2:
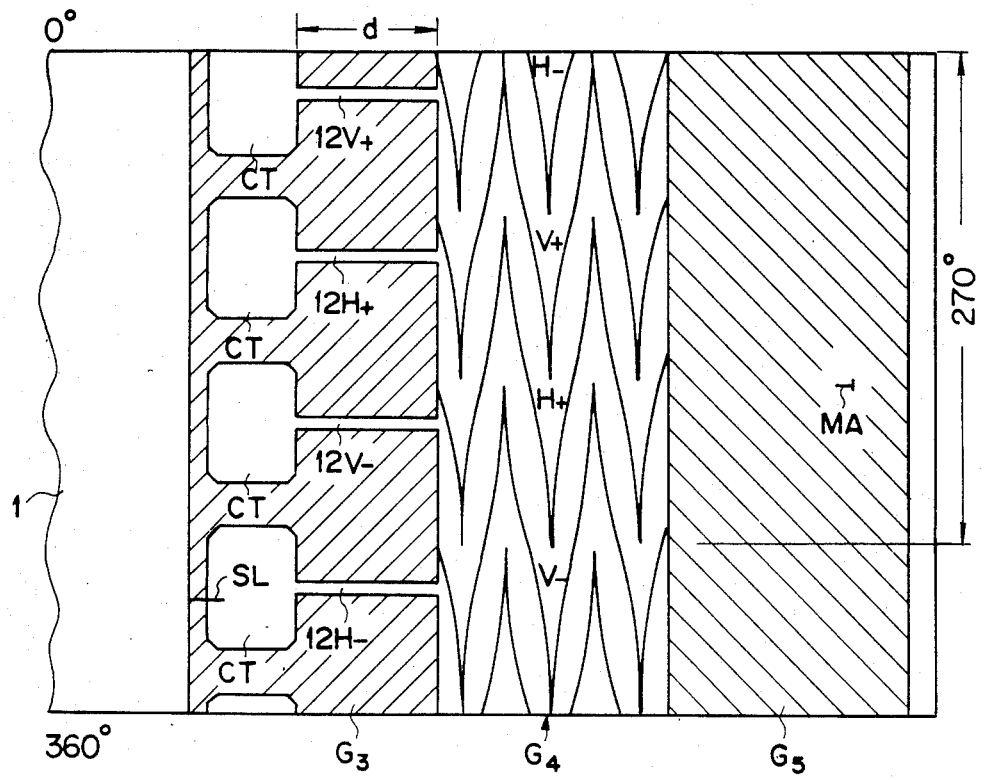
FIG. 2 PRIOR ART
FIG. 2 is a development of essential part in FIG. 1.
Figure 5:
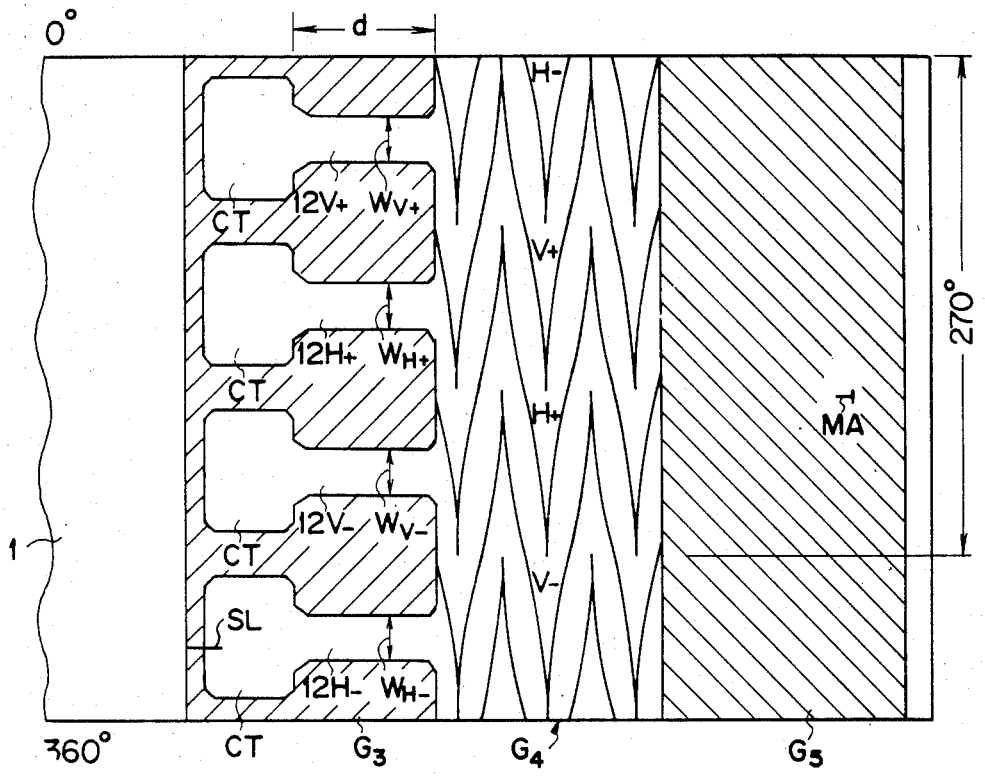
FIG. 5 is a development of essential part of an embodiment of the invention.

The embodiment is an example of application to an image pickup tube (envelope of $\frac{2}{3}$ inches) of electrostatic focusing/electrostatic deflection type (S.S type). An electron gun, a target surface, voltage applying means and the like are constituted in similar manner to FIG. 1 and the description shall be omitted. In the embodiment, patterns of electrodes $G_3$, $G_4$ and $G_5$ are formed as shown in FIG. 5. In FIG. 5, parts corresponding to FIG. 2 are designated by the same symbols and the description shall be omitted.

In FIG. 5, leads (12 $H_+$), (12 $H_-$), (12 $V_+$) and (12 $V_-$) from four electrode portions $H_+$, $H_-$, $V_+$ and $V_-$ are formed at the position respectively corresponding to the center of the electrode portions $H_+$, $H_-$, $V_+$ and $V_-$ in the direction of the circumference thereof respectively and in parallel to the envelope axis. In this case, the widths $W_{H+}$, $W_{H-}$, $W_{V+}$ and $W_{V-}$ are made equal. Each of the widths $W_{H+} \sim W_{V-}$ in this case is larger than that in FIG. 2.

The widths $W_{H+} \sim W_{V-}$ are specified so that the ratio of the sum area S of the leads (12$H_+$)~(12 $V_-$) to the total area $S_0$ corresponding to the leads (12 $H_+$)~(12 $V_-$) (length d of lead x circumference), i.e. ratio $S/S_o$ becomes 0.15~0.60 for example. The reason why such widths are specified will now be described referring to FIG. through FIG. 9.

Figures 6, 9, 12:
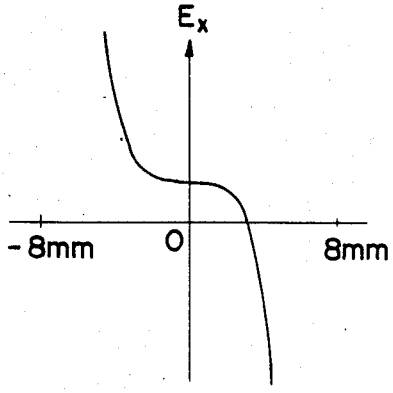
FIG. 6 is a diagram illustrating coma aberration in the embodiment.
FIG. 9 is a graph illustrating the horizontal field distribution in the embodiment.
FIG. 12 is a diagram illustrating coma aberration in embodiments of FIGS. 10 and 11.

FIG. 6 shows results of simulation of the coma aberration when the area ratio $S/S_o$ is varied.

In this case, as the area ratio $S/S_o$ increases, the area occupied by the electrode $G_3$ decreases and therefore the ratio of the real potential produced in the region of the electrode $G_3$ to the voltage applied to the electrode $G_3$ becomes $(1-S/S_o)$ when the center voltage applied to $G_4$ is 0 V. In order to make the real potential in the electrode $G_3$ 500 V for example, the voltage $E_{G3}'$ applied to the electrode $G_3$ must be $500/(1-S/S_o)$. Consequently, as the ratio $S/S_o$ is varied 0, 0.15, 0.20, 0.28, 0.45 and 0.58, the voltage $E_{G3}'$ applied to the electrode $G_3$ is made +500 V, +588 V, +625 V, +694 V, +909 V and +1190 V respectively.

Figure 3:
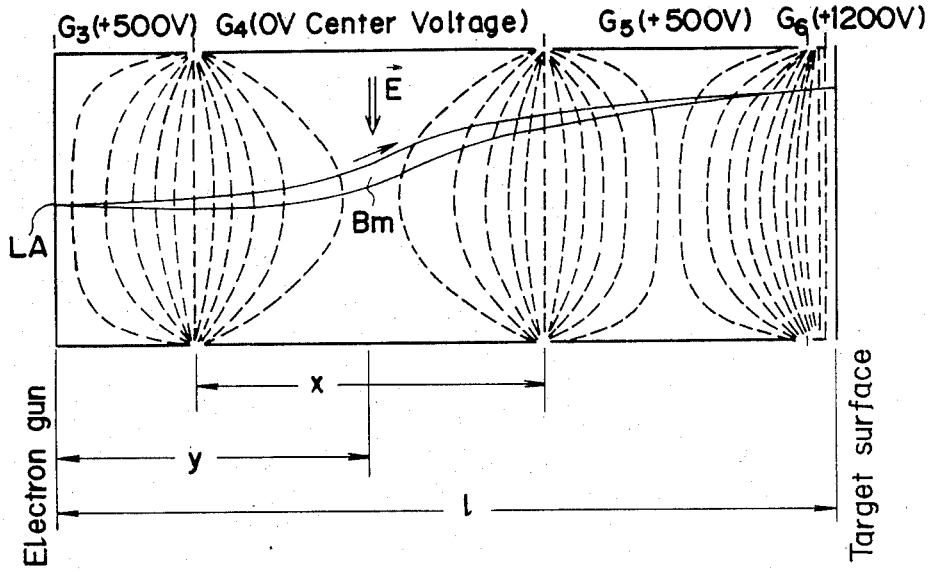
FIG. 3 PRIOR ART
FIG. 3 is a diagram illustrating potential distribution in FIG. 1.
Figure 4:
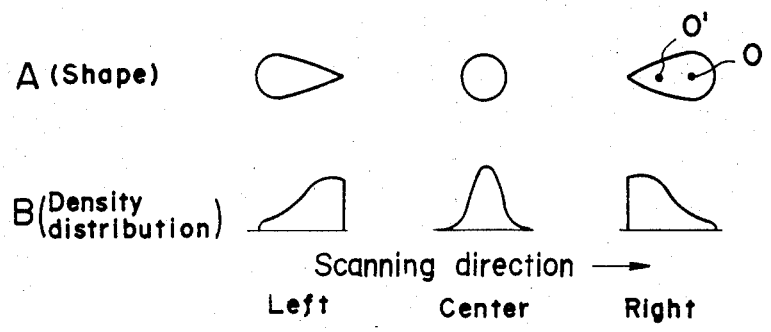
FIG. 4 PRIOR ART
FIG. 4 is a diagram illustrating coma aberration in FIG. 1.
Figure 7:
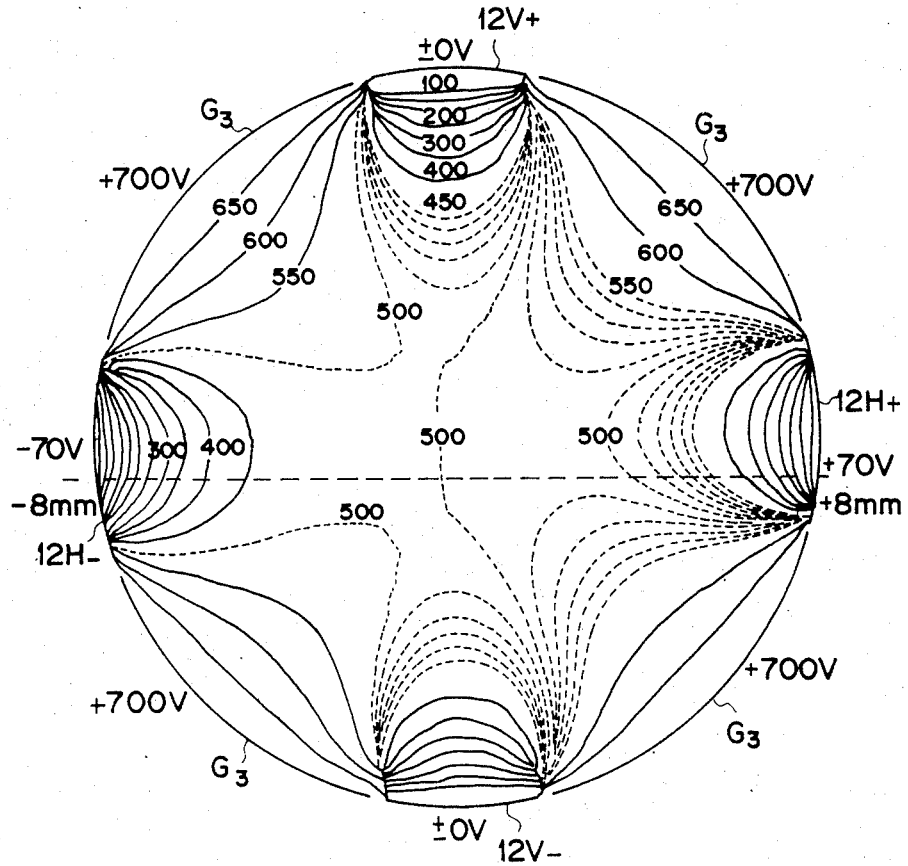
FIG. 7 is a diagram illustrating potential distribution of the embodiment.
Figure 8:
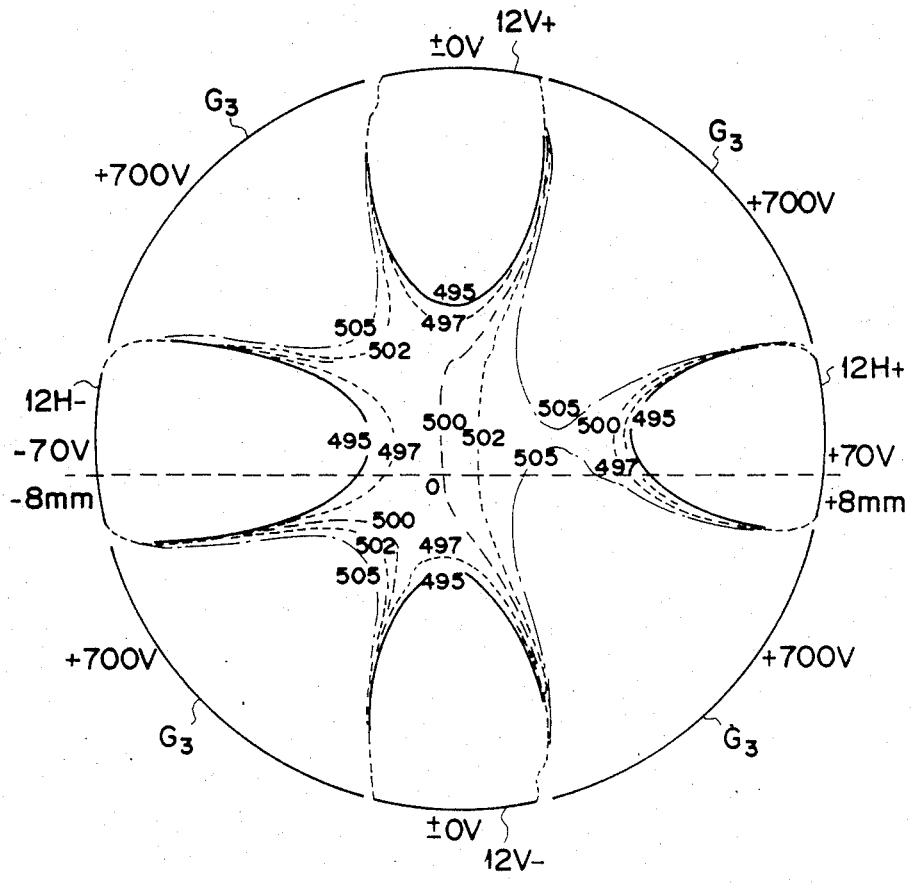
FIG. 8 is a diagram illustrating potential distribution of the embodiment.

FIG. 7 shows the potential distribution at a portion of the electrode $G_3$ when the area ratio $S/S_o=0.28$, and further FIG. 8 shows the potential distribution at portion near the center in detail. Wherein $E_{G3}'=+700$ V and the leads (12 $H_+$) and (12 $H_-$) are supplied with +70 V and −70 V, respectively. In this case, distribution of the horizontal electric field $E_x$ becomes as shown in FIG. 9 and approximately uniform field is obtained adjacent the center. Since the electron beam $B_m$ passes through portion adjacent the center at region of the electrode $G_3$ (refer to FIG. 3), it is subjected to the deflection by the uniform field. Although not shown in the figure, the vertical electric field by the leads (12 $V_+$) and (12 $V_-$) also becomes an approximately uniform field adjacent the center and the electron beam $B_m$ is subjected to the deflection by the uniform field.

Since the horizontal and vertical predeflection of the electron beam $B_m$ is effected by the leads (12 $H_+$)~(12 $V_-$), the deflection voltage applied between the electrode portions $H_+$, $H_-$ and between the electrode portions $V_+$, $V_-$ may be small as the area ratio $S/S_o$ becomes large. Assume that the peak-to-peak value of the deflection voltage $V_{p\text{-}p}$ becomes 119.7 V if the area ratio $S/S_o=0$. Then as the area ratio $S/S_o$ is varied 0.15, 0.20, 0.28, 0.45 and 0.58, the voltage $V_{p\text{-}p}$ becomes 117.8 V, 117.2 V, 116.6 V, 115.1 V and 113.8 V respectively.

When the area ratio $S/S_o$ is made 0.15, 0.20, 0.28, 0.45 and 0.58, ratio of the deflection field $\vec{E}$, formed by the leads (12 $H_+$), (12 $H_-$) [(12 $V_+$), (12 $V_-$)] to the deflection field $\vec{E}$ formed by the electrode portions $H_+$, $H_-$ [$V_+$, $V_-$] becomes 0.2, 0.28, 0.4, 0.6 and 0.8 respectively.

When the area ratio $S/S_o$ is made 0, 0.15, 0.20, 0.28, 0.45 and 0.58 in above-mentioned conditions, the coma aberration becomes 6 μm, 4.2 μm, 3.5 μm, 3 μm, 2 μm and 1 μm respectively.

It follows from FIG. 6 that as the area ratio $S/S_o$ increases the voltage value $E_{G3'}$ to be applied to the electrode $G_3$ increases. For example, if the area ratio $S/S_o=0.58$, $E_{G3}'$ becomes +1190 V and approximately equal to a voltage +1200 V which is to be applied to the mesh electrode $G_6$. Consequently, if the area ratio is further increased beyond such value, problem of discharging or the like may occur. For example, if the area ratio $S/S_o=0.58$, a the coma aberration becomes 1 μm and there exists little influence from the coma aberration. Increase of the area ratio $S/S_o$ beyond such value is meaningless also in view of the object to reduce the coma aberration, and it may rather increase the coma aberration in the reverse direction. Consequently, the area ratio $S/S_o$ being less than 0.60 is preferable from this point of view.

On the other hand, characteristics of the resolution in a black-and-white image pickup tube will be studied. When the area ratio $S/S_o=0$, the resolution at the right becomes about half of that at the left. When the area ratio $S/S_o=0.28$, the resolution is nearly equal at the right and at the left. When the area ratio $S/S_o=0.15$, the resolution at the right is fixed to be about 0.8 times of that at the left and the visual sense is not so insured. Consequently, the area ratio $S/S_o$ being more than 0.15 is preferable from this point of view.

On the basis of the above study, in FIG. 5, widths $W_{H+}$, $W_{H-}$, $W_{V+}$ and $W_{V-}$ of the leads (12 $H_+$), (12 $H_-$), (12 $V_+$) and (12 $V_-$) are specified so that the ratio $S/S_o$ becomes 0.15~0.60, for example. In the envelope of $\frac{2}{3}$ inches, since the electrode circumference is 50.3 mm, if the ratio $S/S_o=0.28$ for example, each of the widths $W_{H+}$, $W_{H-}$, $W_{V+}$ and $W_{V-}$ is made to be 3.6 mm. In addition, FIG. 5 is drawn in dimension so that the ratio $S/S_o$ becomes 0.28. Construction except for the above description is made similar to FIG. 2.

In the embodiment where patterns of the electrodes $G_3$, $G_4$ and $G_5$ particularly the leads (12 $H_+$)~(12 $V_-$) are formed as shown in FIG. 5, pre-deflection of the electron beam $B_m$ is effected by the leads (12 $H_+$)~(12 $V_-$) and the coma aberration is significantly reduced as shown in FIG. 6. Consequently, the for example, difference of the resolution between the right side and the left side of the frame can be reduced and the approximately uniform resolution can be obtained throughout the frame. Moreover, the pre-deflection improves the deflection sensitivity.

Although the deflection electrode is divided into the four electrode portions of arrow pattern in the embodiment of FIG. 5, it may be divided into four electrode portions of leaf pattern.

Figure 10:
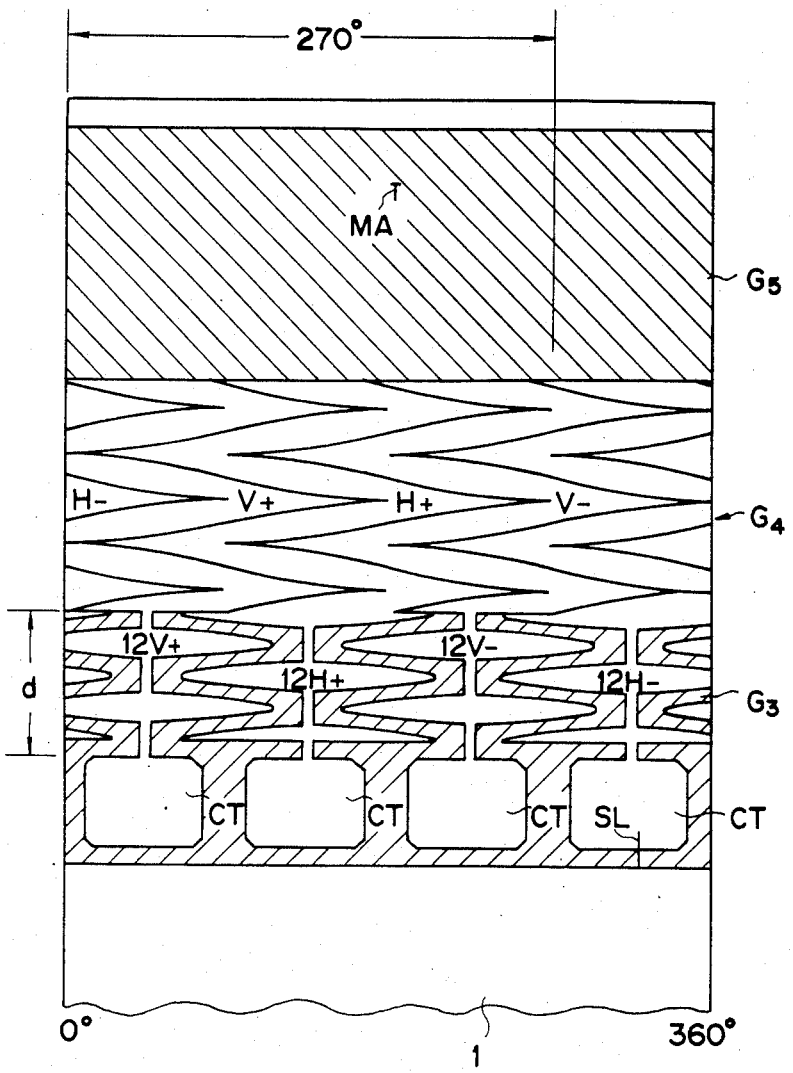
FIG. 10 is a development of essential part of a second embodiment of the invention.
Figure 11:
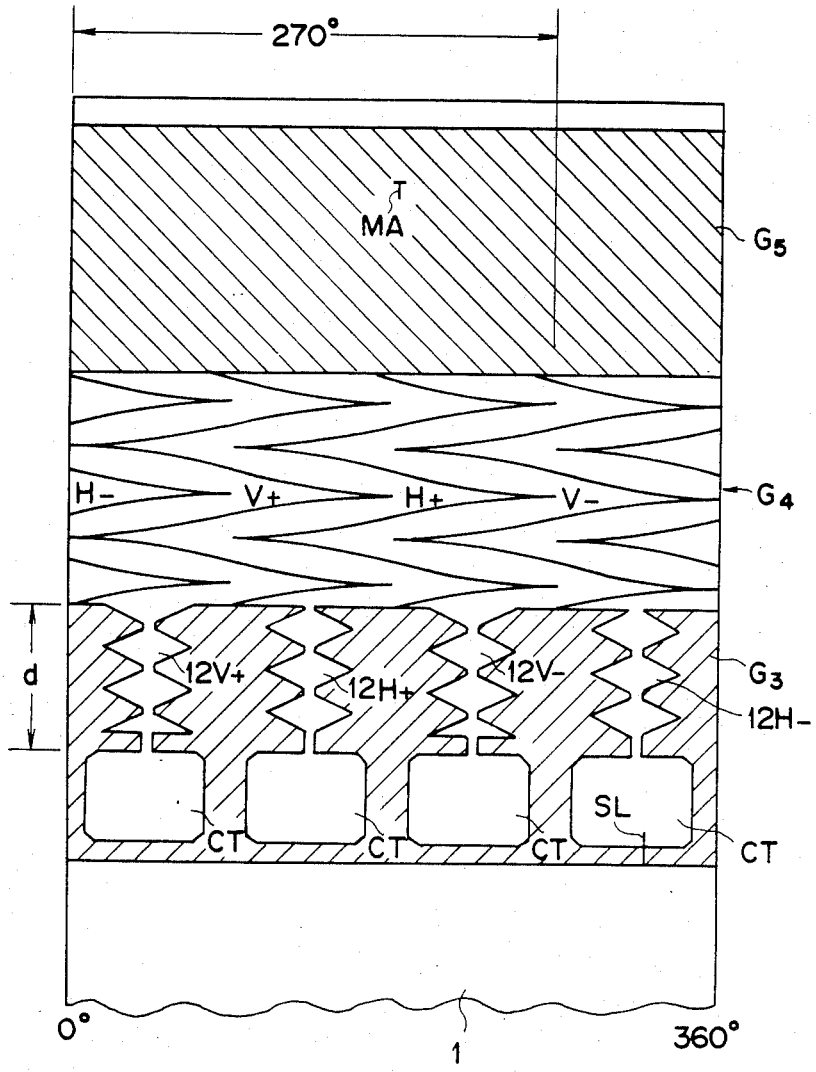
FIG. 11 is a development of essential part of a third embodiment of the invention.

FIG. 10 and FIG. 11 show other embodiments of the invention, and leads (12 $H_+$)~(12 $V_-$) are formed in leaf pattern and rhombic pattern respectively so that uniform field region of the deflection is widened. Construction except for the above description is made similar to FIG. 5.

FIG. 12 shows results of simulation when the leads (12 $H_+$)~(12 $V_-$) are formed in pattern as shown in FIG. 10 and the area ratio $S/S_o$ is 0.58. Results in this case are similar to results obtained when the leads (12 $H_+$)~(12 $V_-$) are formed linearly as shown in FIG. 5 (refer to FIG. 6 for item of $S/S_o=0.58$).

Consequently, a similar working effect can be obtained also when the leads (12 $H_+$)~(12 $V_-$) are formed in patterns as shown in FIG. 10 or FIG. 11 if the area ratio $S/S_o$ is selected as shown in FIG. 5.

In addition, FIG. 10 is drawn in dimension so that the area ratio $S/S_o$ becomes 0.50, and FIG. 11 is drawn in dimension so that the area ratio $S/S_o$ becomes 0.28.

Figure 13:
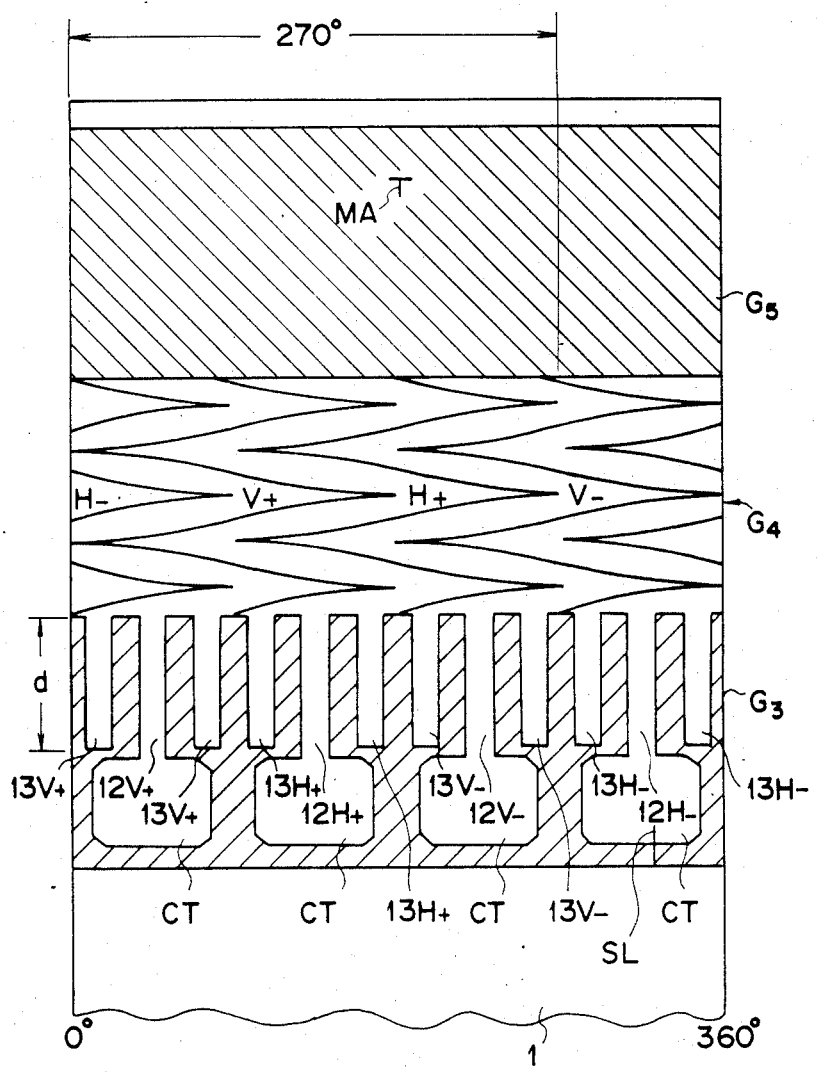
FIG. 13 is a development of essential part of a fourth embodiment of the invention.

FIG. 13 shows a fourth embodiment of the invention. In this case, leads (12 $H_+$)~(12 $V_-$) are formed from four electrode portions $H_+$~$V_-$, and extensions (13 $H_+$)~(13 $V_-$) in parallel to the leads (12 $H_+$)~(12 $V_-$) are formed also from the four electrode portions $H^+$~$V_-$. The electrode $G_3$ is formed comblike. In this case, pre-deflection of the electron beam $B_m$ is effected by co-operation of the leads (12 $H_+$)~(12 $V_-$) and the extensions (13 $H_+$)~(13 $V_-$). Consequently, a similar working effect can be obtained when the extensions (13 $H_+$)~(13 $V_-$) are formed as shown in FIG. 13 if the area ratio $S/S_o$ (area S including area of extensions (13 $H_+$)~(13 $V_-$)) is selected as shown in FIG. 5.

In addition, FIG. 13 is drawn in dimension so that the area ratio $S/S_o$ becomes 0.50.

Figure 14:
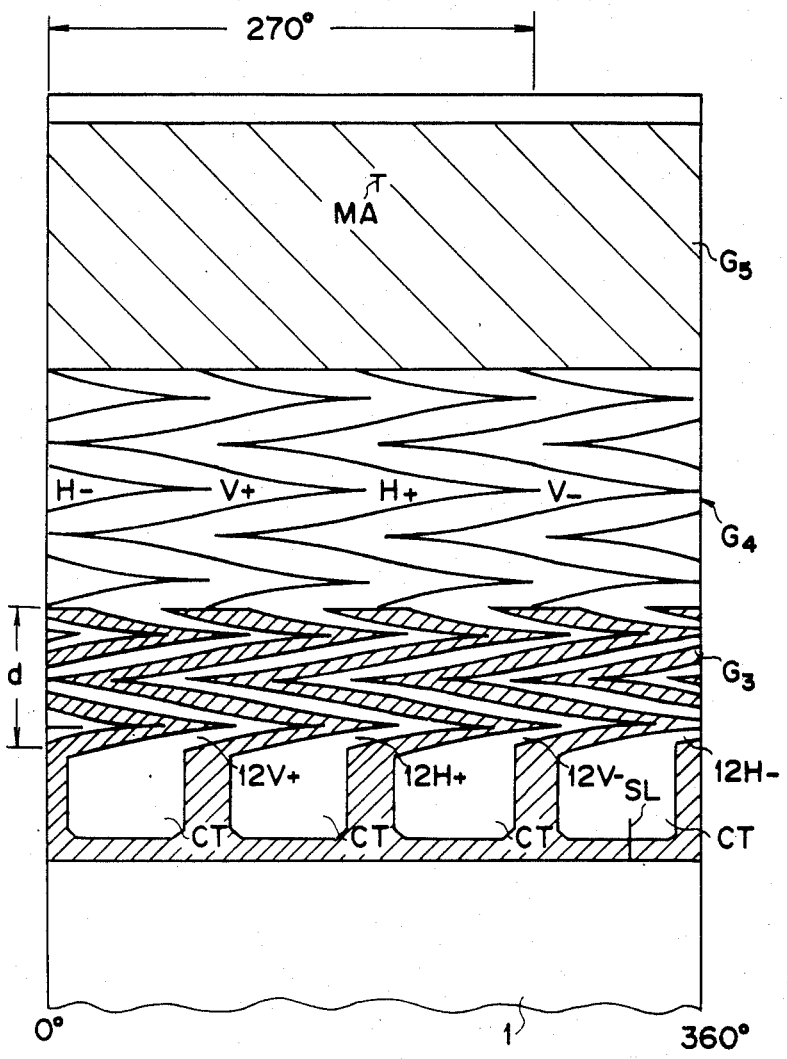
FIG. 14 is a development of essential part of a fifth embodiment of the invention.

FIG. 14 shows a fifth embodiment of the invention. In this case, leads (12 $H_+$)~(12 $V_-$) are formed in so-called arrow pattern. The construction except for the above description is made similar to FIG. 5.

In FIG. 14, since the leads (12 $H_+$)~(12 $V_-$) are formed in arrow pattern, a pre-deflection field is formed uniformly in a similar manner to FIG. 10 in leaf pattern thereby distortion of the deflection may be reduced.

A similar working effect can be obtained also in the construction shown in FIG. 14, if the area ratio $S/S_o$ is selected as shown in FIG. 5. In addition, FIG. 14 is drawn in dimensions so that the area ratio $S/S_o$ becomes 0.60.

Although the envelope diameter of $\frac{2}{3}$ inches is given in the above embodiments, the invention may be applied to envelopes of any size. Although the electrodes $G_3$~$G_5$ are formed by deposition on the inner surface of the glass bulb 1 in the above embodiments, the invention can be applied also to electrodes formed by a metal plate for example. Further, although the above embodiments are of the unipotential type, the invention may be also applied to bipotential types.

According to the invention as clearly seen in the above embodiments, the pre-deflection of the electron beam is effected by the leads or the like from four electrode portions of the deflection electrode such that the coma aberration is significantly reduced. Consequently, for example, difference of the resolution between the right side and the left side of the frame can be reduced and the approximately uniform resolution can be obtained throughout the frame. Moreover, the pre-deflection improves the deflection sensitivity.

What is claimed is:

1. An image pick-up tube comprising:

(a) an envelope;

(b) an election beam source positioned at one end of said envelope;

(c) a target positioned at another end of said envelope opposite to said electron beam source; and (d) an electrostatic lens means positioned between said electron beam source and said target, said lens means having a first cylindrical electrode and a second cylindrical electrode respectively positioned along said electron beam path to focus said electron beam, said second cylindrical electrode being divided into four patterned deflection electrodes, each of said deflection electrodes having a lead which is formed across said first cylindrical electrode and is electrically isolated therefrom, wherein a portion of said lead is connected to said second electrode and is lying in the area where said first electrode is positioned, and a ratio S/SO is selected in the range from 0.15 to 0.60 where S is sum of each area of said portion of said leads and so is the sum of total area of said first electrode and S, whereby said portion causes a pre-deflection to said electron beam.

2. A cathode ray tube according to claim 1, wherein said electrostatic lens means further comprise a third cylindrical electrode.

3. A cathode ray tube according to claim 2, wherein all of said electrodes including said leads, which constitute said electrostatic lens means are formed on the inner surface of said envelope.

4. A cathode ray tube according to claim 1, wherein said portion of said leads is straight in parallel with the axis of said envelope.

5. A cathode ray tube according to claim 1, wherein said portion of said leads comprises leaf-like portions.

6. A cathode ray tube according to claim 1, wherein said portion of said leads comprises arrow-like portions.

* * * * *